US005913770A

United States Patent [19]

Tseng

[11] Patent Number: 5,913,770

[45] Date of Patent: Jun. 22, 1999

[54] FOLDING SOFA-BED FRAME

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 08/991,204

[22] Filed: Dec. 16, 1997

[51] Int. Cl.[6] ..... A47C 17/17

[52] U.S. Cl. ..... 5/37.1; 5/41; 5/52; 5/18.1

[58] Field of Search ..... 5/12.1, 37.1, 41, 5/18.1, 39, 44.1, 47, 48, 52, 632, 617

[56] References Cited

U.S. PATENT DOCUMENTS

| | | | |
|---|---|---|---|
| 1,104,487 | 7/1914 | Fischer | 5/617 |
| 1,903,224 | 3/1933 | Oehrl | 5/617 |
| 4,608,722 | 9/1986 | Zorzetto | 5/18.1 |
| 4,939,802 | 7/1990 | Lafer | 5/41 X |
| 5,519,902 | 5/1996 | Meade | 5/47 X |

FOREIGN PATENT DOCUMENTS

| | | | |
|---|---|---|---|
| 121867 | 10/1984 | European Pat. Off. | 5/37.1 |

*Primary Examiner*—Michael F. Trettel
*Attorney, Agent, or Firm*—Ladas & Parry

[57] ABSTRACT

A folding sofa-bed frame includes a horizontal base frame section, a planar backrest frame section, a planar connecting frame section, a horizontal foot frame section, and a variable-length telescopic unit. The backrest frame section is disposed above the base frame section and has a rear end mounted pivotally on the base frame section. The connecting frame section has a rear end connected pivotally to a front end of the backrest frame section. The foot frame section has a rear end connected pivotally to a front end of the connecting frame section. The telescopic unit has one end mounted on a front end of the foot frame section, and an opposite end coupled to the base frame section. The sofa-bed frame can be actuated from an extended bed frame position, where the telescopic unit has a maximum length and the backrest frame section, the connecting frame section and the foot frame section are arranged in a horizontal plane, to a sofa forming position, where the telescopic unit has a minimum length, the backrest frame section and the connecting frame section are arranged side-by-side and extend generally uprightly relative to the base frame section, and the foot frame section extends above the base frame section.

10 Claims, 5 Drawing Sheets

FOLDING SOFA-BED FRAME

BACKGROUND OF THE INVENTION

1. Field of the Invention

The invention relates to a sofa-bed, more particularly to a folding sofa-bed frame which is adjustable in length in a sofa forming position.

2. Description of the Related Art

Conventional folding sofa-bed frames, such as those disclosed in U.S. Pat. Nos. 4,398,311, 4,507,987, and 4,527,342, are generally mounted in an upholstered sofa structure and comprise pivotally connected bed sections that are capable of being actuated into an extended bed forming position or a sofa seat-forming position. It is noted that the conventional folding sofa-bed frames do not permit adjustments in the lengths thereof in the sofa seat-forming position. Nor do they provide a backrest in the extended bed forming position.

SUMMARY OF THE INVENTION

Therefore, the main object of the present invention is to provide a folding sofa-bed frame which is adjustable in length in a sofa forming portion.

Another object of the present invention is to provide a folding sofa-bed frame with an angle-adjustable backrest when in the extended bed forming position.

Accordingly, the folding sofa-bed frame of the present invention comprises a horizontal base frame section, a planar backrest frame section disposed above the base frame section and having a front end and a rear end mounted pivotally on the base frame section, a planar connecting frame section having a front end and a rear end connected pivotally to the front end of the backrest frame section, a horizontal foot frame section having a front end and a rear end connected pivotally to the front end of the connecting frame section, and a variable-length telescopic unit having one end mounted on the front end of the foot frame section and an opposite end coupled to the base frame section.

The sofa-bed frame can be actuated from an extended bed frame position, where the telescopic unit has a maximum length and the backrest frame section, the connecting frame section and the foot frame section are arranged in a horizontal plane, to a sofa forming position, where the telescopic unit has a minimum length, the backrest frame section and the connecting frame section are arranged side-by-side and extend generally uprightly relative to the base frame section, and the foot frame section extends above the base frame section.

Preferably, the base frame section includes a parallel pair of front and rear base frame rods, and a parallel pair of slide bars which interconnect left and right ends of the front and rear base frame rods. The rear end of the backrest frame section is mounted pivotally on the rear base frame rod, and the opposite end of the telescopic unit is coupled to the slide bars.

The backrest frame section includes an outer backrest frame having a parallel pair of support sections disposed above the slide bars, and a bridging section transverse to the support sections and interconnecting rear ends of the support sections. The rear ends of the support sections are mounted pivotally on the rear base frame rod. The support sections have front ends connected pivotally to the rear end of the connecting frame section.

The backrest frame section further includes at least one inner backrest frame confined by the outer backrest frame.

The inner backrest frame has a front end mounted pivotally to the front ends of the support sections. Prop means, provided on the inner and outer backrest frames, support releasably the inner backrest frame at a desired inclination relative to the outer backrest frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
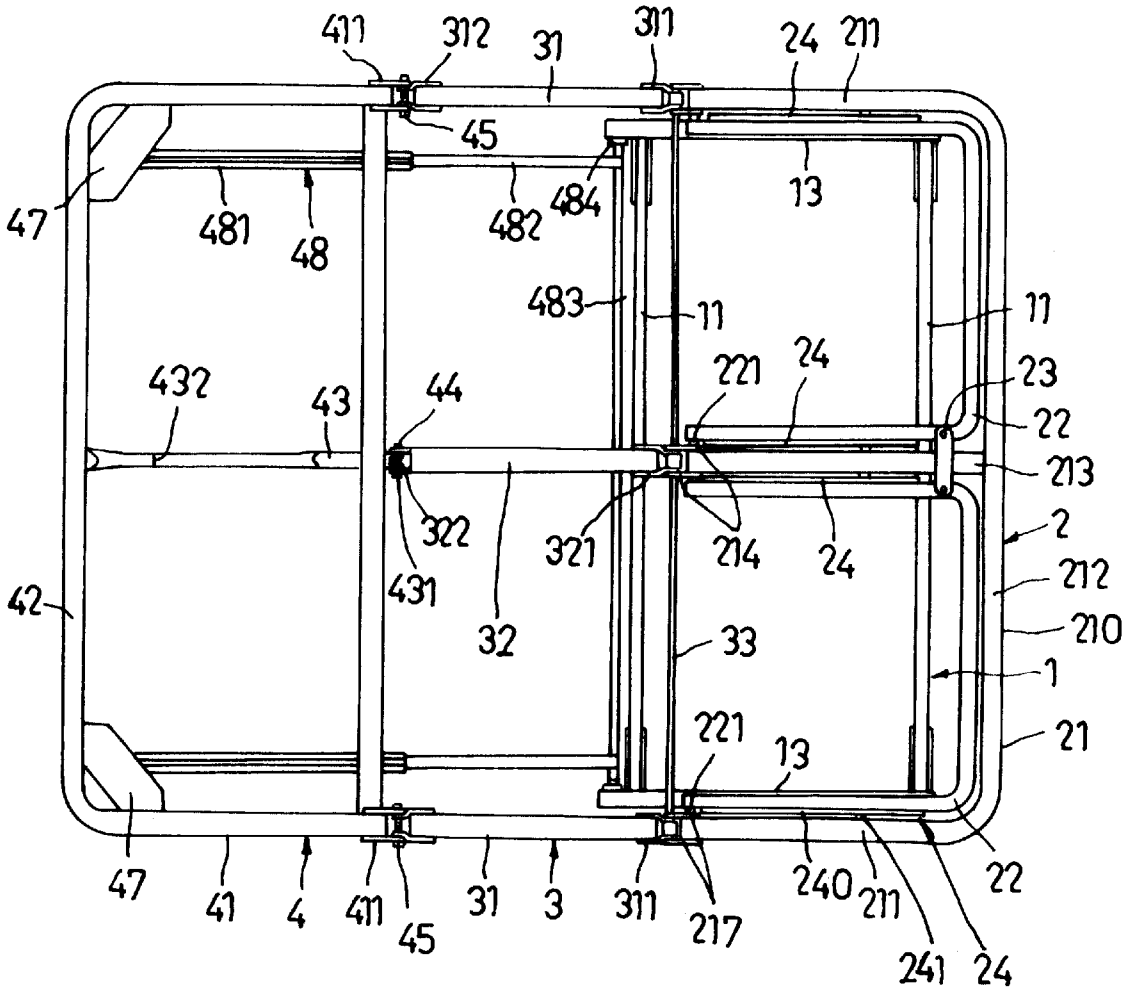
FIG. 1 is a top view of the preferred embodiment of a folding sofa-bed frame according to the present invention when in the extended bed forming position.
Figure 2:
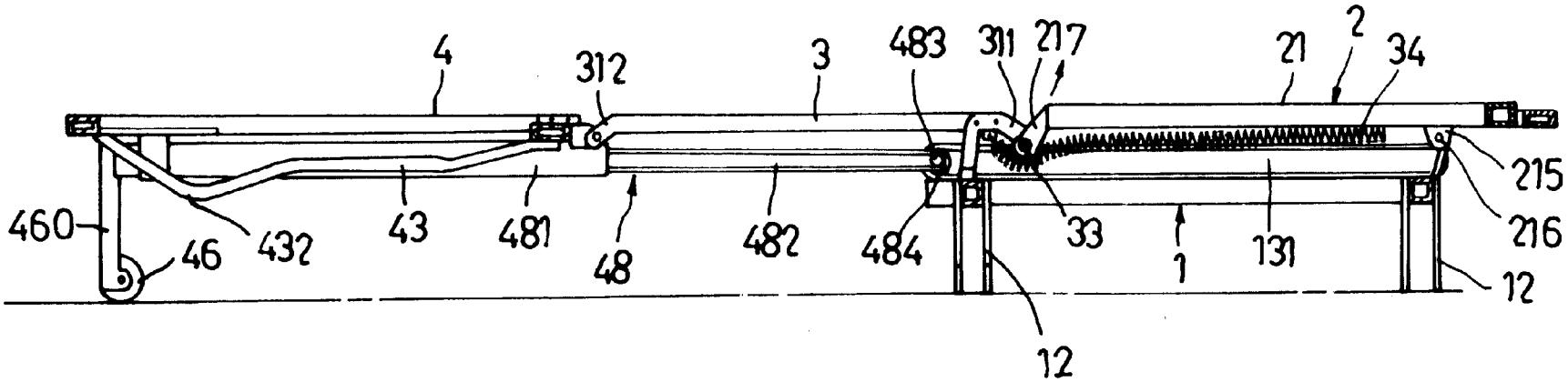
FIG. 2 is a schematic partly sectional side view of the preferred embodiment in the extended bed forming position.

Referring to FIGS. 1 and 2, the preferred embodiment of a folding sofa-bed frame according to the present invention is shown to comprise a horizontal base frame section 1, a planar backrest frame section 2, a planar connecting frame section 3, a horizontal foot frame section 4, and a variable-length telescopic unit 48.

The base frame section 1 includes a parallel pair of front and rear base frame rods 11, each of which has left and right ends provided with a respective leg member 12 for supporting the base frame section 1 on the ground. Each of a parallel pair of slide bars 13 interconnects the base frame rods 11 at the left and right ends of the same in a direction transverse to the base frame rods 11. Each of the slide bars 13 has an inner face formed with an elongated slide groove 131 that extends longitudinally thereof.

The backrest frame section 2 is disposed above the base frame section 1 and includes an outer backrest frame 21 and a pair of inner backrest frames 22. The outer backrest frame 21 has a parallel pair of support sections 211 disposed above the slide bars 13, and a bridging section 212 which is transverse to the support sections 211 and which interconnects the rear ends of the support sections 211. A partition bar 213 extends from an intermediate portion of the bridging section 212 and is parallel to the support sections 211. A pair of first pivot lugs 214 is provided on a front end of the partition bar 213 opposite to the bridging section 212. A downwardly extending second pivot lug 215 is provided on an inner face of each of the support sections 211 at a rear end adjacent to the bridging section 212. A first pivot shaft 216 extends through the second pivot lugs 215 on the support sections 211 to mount pivotally the outer backrest frame 21 on left and right ends of the rear base frame rod 11 of the base frame section 1. Each of the support sections 211 is further provided with a pair of downwardly extending third pivot lugs 217 at a front end opposite to the bridging section 212. Each of the inner backrest frames 22 is disposed between the partition bar 213 and a respective one of the support sections 211. Each of the inner backrest frames 22 is provided with two second pivot shafts 221 at a front end for mounting pivotally the inner backrest frames 22 onto the partition bar 213 and the respective support section 211. A link 23 interconnects the inner backrest frames 22 at a rear end adjacent to the bridging section 212 to permit simultaneous movement of the inner backrest frames 22.

Figure 3:
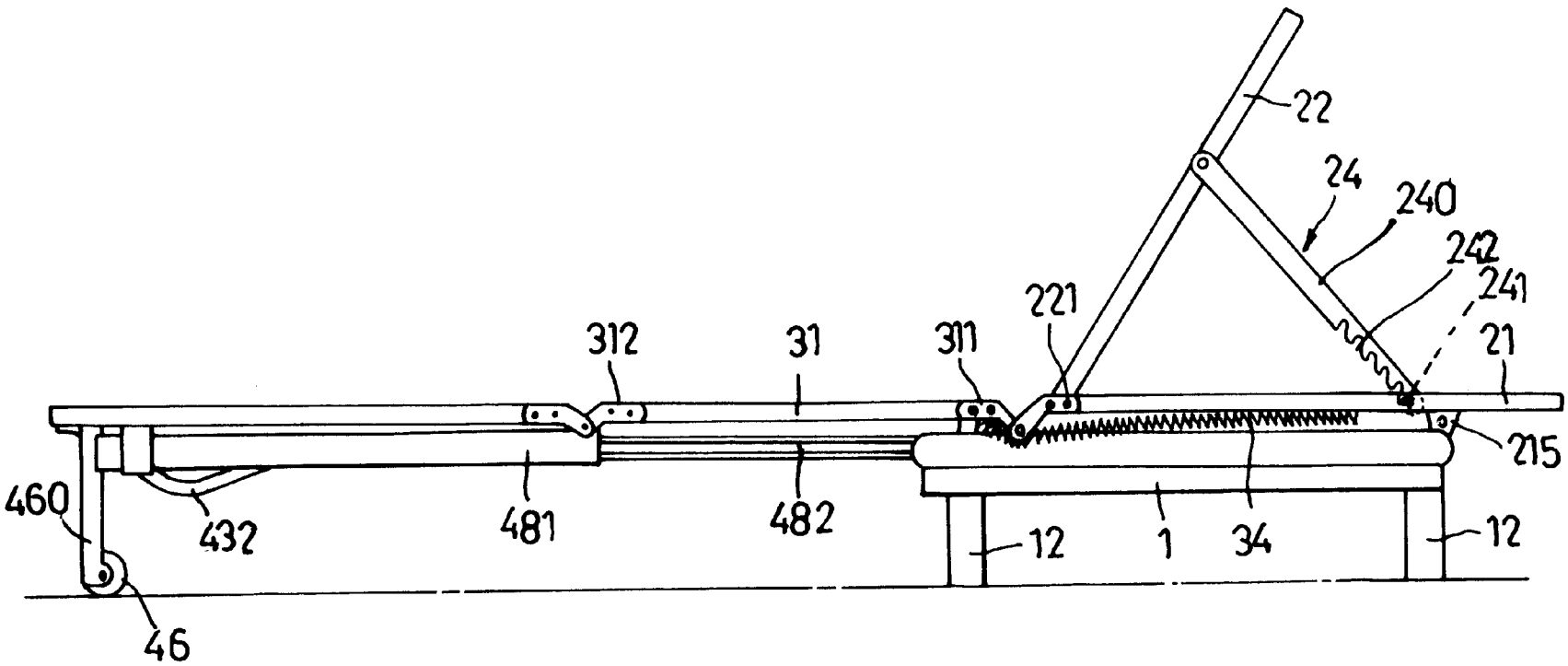
FIG. 3 is a schematic side view of the preferred embodiment in the extended bed forming position, illustrating an inner backrest frame supported in an inclined position to form an angle-adjustable backrest.

Referring to FIGS. 1 and 3, four sets of prop units 24 are provided on the inner backrest frames 22 and the outer backrest frame 21 to support the inner backrest frames 22 at a desired inclination relative to the outer backrest frame 21 when the inner backrest frames 22 are pivoted about the second pivot shafts 221. Each prop unit 24 includes an elongated locking plate 240 disposed on an outer side of one of the inner backrest frames 22, and a locking projection 241 provided on an inner side of one of the support sections 211 or on one side of the partition bar 213. The locking plate 240 has a first end portion mounted pivotally on the corresponding inner backrest frame 22, and a second end portion with a lower edge that is formed with a series of engaging notches 242. By engaging the locking projection 241 in an appropriate one of the engaging notches 242, each inner backrest frame 22 can be supported at a desired inclination relative to the outer backrest frame 21 when the inner backrest frame 22 is pivoted about the corresponding second pivot shafts 221.

Referring again to FIGS. 1 and 2, the connecting frame section 3 includes a parallel pair of side bars 31 which are aligned respectively with the support sections 211 of the outer backrest frame 21, and an intermediate bar 32 which is aligned with the partition bar 213 of the outer backrest frame 21. The front and rear ends of each of the side bars 31 are formed respectively with a pair of fourth pivot lugs 312 and a pair of fifth pivot lugs 311. The front and rear ends of the intermediate bar 32 are formed respectively with a pair of sixth pivot lugs 322 and a pair of seventh pivot lugs 321. The fifth and seventh pivot lugs 311, 321 correspond respectively to the third and first pivot lugs 217, 214 on the outer backrest frame 21. A pivot rod 33 extends through the first, third, fifth and seventh pivot lugs 214, 217, 311, 321 to mount pivotally the connecting frame section 3 on the outer backrest frame 21. Each of a pair of springs 34 has a first end mounted on one side of the partition bar 213 of the outer backrest frame 21, and a second end mounted on a respective one of the seventh pivot lugs 321.

The foot frame section 4 includes a parallel pair of side shafts 41 which are aligned respectively with the side bars 31 of the connecting frame section 3, and a connecting shaft 42 which interconnects front ends of the side shafts 41 in a direction transverse to the latter. A mounting shaft 40 is parallel to the connecting shaft 42 and has opposite left and right ends mounted on rear ends of the side shafts 41. A limiting shaft 43 extends between intermediate portions of the mounting and connecting shafts 40, 42 and is parallel to the side shafts 41. The limiting shaft 43 has a rear end formed with a pair of eighth pivot lugs 431 that are connected pivotally to the sixth pivot lugs 322 on the intermediate bar 32 of the connecting frame section 3 by means of a third pivot shaft 44. The limiting shaft 43 is formed with a downwardly extending limiting portion 432. The rear end of each of the side shafts 41 is provided with a pair of ninth pivot lugs 411 that are connected pivotally to the fourth pivot lugs 312 on the corresponding one of the side bars 31 of the connecting frame section 3 by means of a fourth pivot shaft 45. In order to facilitate movement of the foot frame section 4 toward or away from the base frame section 1, the left and right ends of the connecting shaft 42 are provided with a respective post member 460. Each of the post members 460 has a caster 46 provided thereon. The foot frame section 4 further includes a pair of positioning plates 47, each of which is mounted on a respective one of two corner portions that are formed by the side shafts 41 with the connecting shaft 42.

The telescopic unit 48 couples the positioning plates 47 to the slide bars 13 of the base frame section 1. The telescopic unit 48 includes a pair of tubular stationary members 481, each of which has a front end portion mounted on a respective one of the positioning plates 47, and an open rear end portion that extends toward and below the mounting shaft 40. The telescopic unit 48 further includes a pair of elongated slide members 482, each of which has a front end portion that extends slidably into the rear end portion of a respective one of the stationary members 481, and a rear end portion that extends toward a respective one of the slide bars 13. A transverse axle 483 interconnects the rear end portions of the slide members 482, and a pair of rollers 484 are provided on opposite ends of the axle 483 and are received in the slide grooves 131 of the slide bars 13, respectively.

Referring again to FIGS. 1 and 2, in the extended bed forming position, the length of the telescopic unit 48 is at a maximum, and the backrest frame section 2, the connecting frame section 3 and the foot frame section 4 are arranged in a horizontal plane to permit reclining of a person thereon. A mattress (not shown) can be placed on each of the inner backrest frames 22, the connecting frame section 3 and the foot frame section 4 for user comfort. The sofa-bed frame is supported on the ground by the four leg members 12 and the two casters 46 at this time.

Referring once more to FIGS. 1 and 3, when it is desired to form an angle-adjustable backrest while the sofa-bed frame is in the extended bed forming position, the inner backrest frames 22 of the backrest frame section 2 are pivoted upwardly about the second pivot shafts 221. Thereafter, the locking projections 241 are engaged in selected engaging notches 242 of the locking plates 240 to support the inner backrest frames 22 at the desired inclination relative to the outer backrest frame 21 to permit lying of the back of the user thereon.

Figure 4:
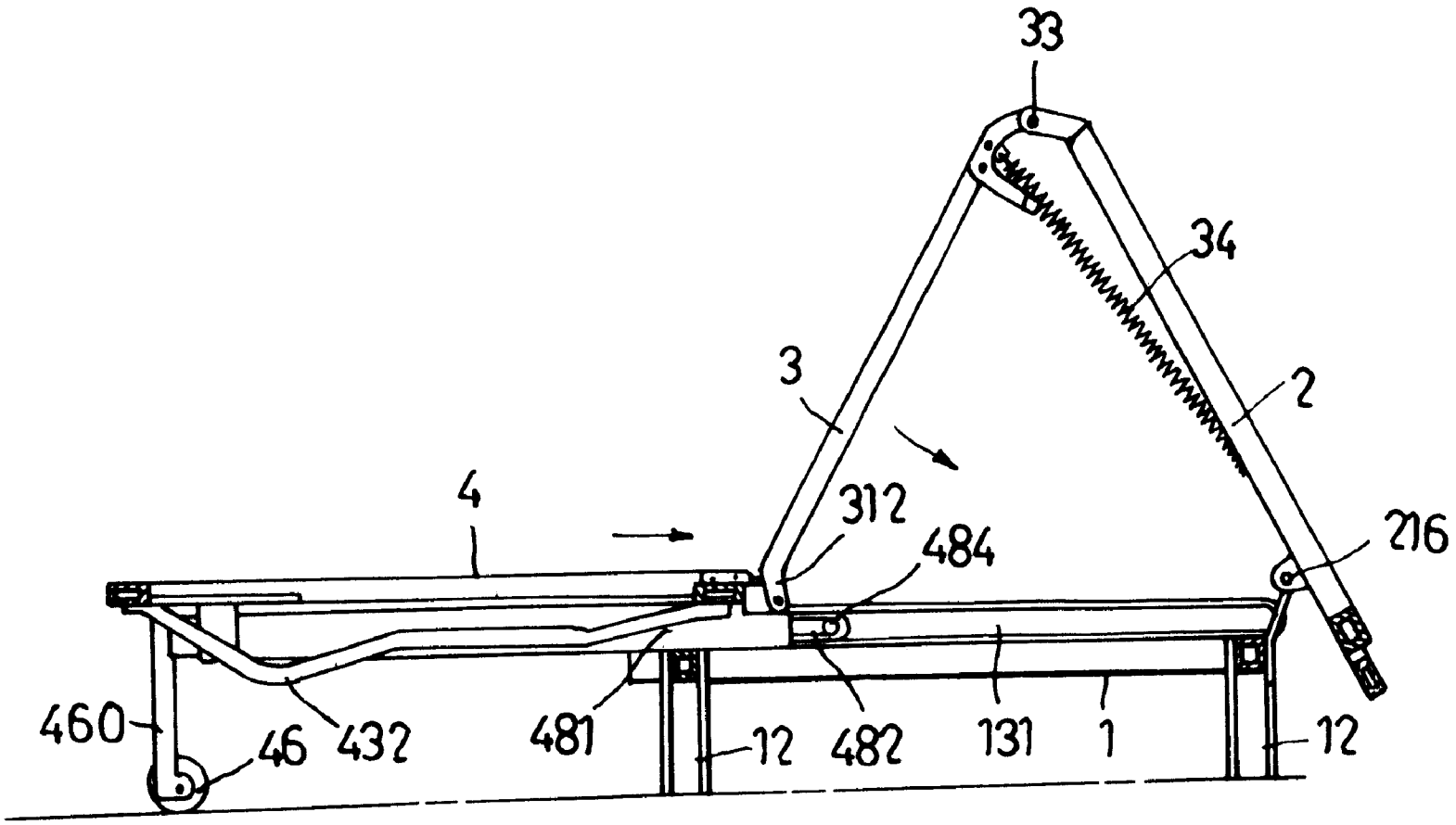
FIG. 4 is a schematic partly sectional side view illustrating how the preferred embodiment is actuated from the extended bed forming position to the sofa forming position.

Referring to FIGS. 2 and 4, when it is desired to actuate the sofa-bed frame from the extended bed forming position to the sofa forming position, under the state that the inner backrest frames 22 are coplanar with the outer backrest frame 21, the pivot rod 33 is pulled upwardly, thereby lifting the front end of the backrest frame section 2 and the rear end of the connecting frame section 3 away from the base frame section 1. Due to the action of the springs 34 which interconnect the backrest frame section 2 and the connecting frame section 3, the connecting frame section 3 is pulled toward the backrest frame section 2 as the latter pivots about the first pivot shaft 216. The fourth pivot lugs 312 on the connecting frame section 3, which are connected pivotally to the foot frame section 4, move toward the base frame section 1, thereby pulling the foot frame section 4 toward the base frame section 1. At this time, the stationary members 481 of the telescopic unit 48 also move toward the base frame section 1, thereby retracting the slide members 482 therein.

Figure 5:
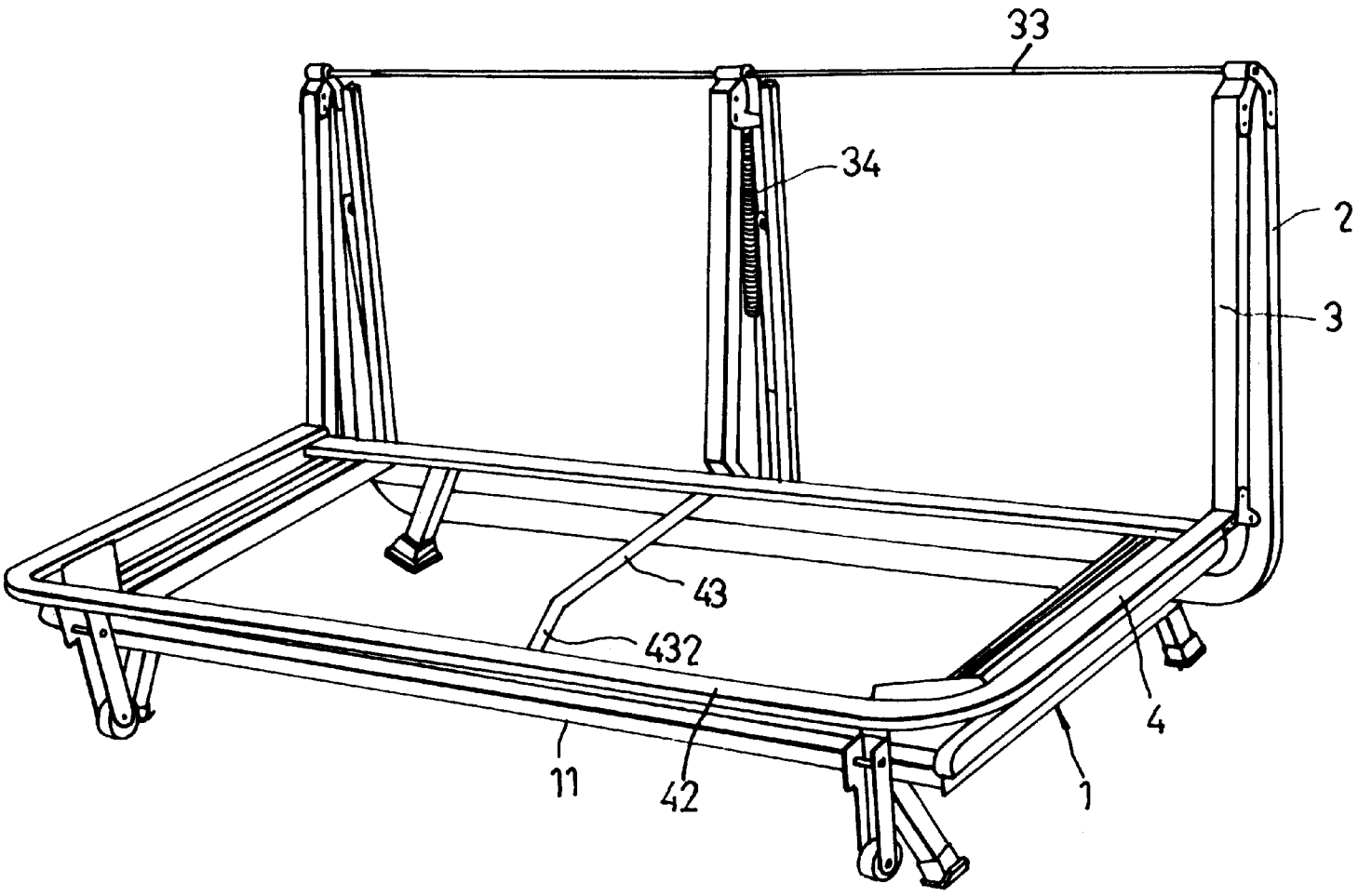
FIG. 5 is a perspective view illustrating the preferred embodiment in the sofa forming position.

Referring to FIGS. 4 and 5, as the connecting frame section 3 is brought closer to the backrest frame section 2, the foot frame section 4 continues to move toward the base frame section 1 such that the rollers 484 of the telescopic unit 48 move rearward along the slide grooves 131. This action is continued until the limiting portion 432 of the limiting shaft 43 has moved past the front base frame rod 11 of the base frame section 1 by virtue of the pivoting connection between the connecting frame section 3 and the foot frame section 4 by means of the pivot shafts 44, 45, thereby preventing undesired movement of the foot frame section 4 away from the base frame section 1 when the sofa-bed frame is in the sofa forming position. At this time, the length of the telescopic unit 48 is at a minimum, the backrest frame section 2 and the connecting frame section 3 are arranged side-by-side and extend generally uprightly from the base frame section 1 to form a backrest for the sofa-bed frame, and the foot frame section 4 extends above the base frame section 1 to form a seat for the sofa-bed frame.

Accordingly, to actuate the sofa-bed frame from the sofa forming position to the extended bed forming position, the connecting shaft 42 is pulled upwardly so as to cause the foot frame section 4 to pivot about the pivot shafts 44, 45 in order to permit movement of the limiting portion 432 of the limiting shaft 43 past the front base frame rod 11 of the base frame section 1. The foot frame section 4 is then pulled forwardly against the action of the springs 34 until the rollers 484 of the telescopic unit 48 abut against the front edges of the slide grooves 131 in the slide bars 13 of the base frame section 1. At this time, the backrest frame section 2, the connecting frame section 3 and the foot frame section 4 can be arranged in a horizontal plane such that the sofa-bed frame is once again in the extended bed forming position, as shown in FIG. 2.

It has thus been shown that the folding sofa-bed frame of this invention can have an adjustable length in the sofa forming position due to the telescopic unit 48 between the foot frame section 4 and the base frame section 1. In addition, in view of the arrangement of the outer and inner backrest frames 21, 22, the folding sofa-bed frame of this invention can be provided with an angle-adjustable backrest when in the extended bed forming position. The objects of the present invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A folding sofa-bed frame, comprising:

a horizontal base frame section;

a planar backrest frame section disposed above said base frame section and having a front end and a rear end mounted pivotally on said base frame section;

a planar connecting frame section having a front end and a rear end connected pivotally to said front end of said backrest frame section;

a horizontal foot frame section having a front end and a rear end connected pivotally to said front end of said connecting frame section, a variable-length telescopic unit having one end mounted on said front end of said foot frame section and an opposite end coupled to said base frame section;

said sofa-bed frame being capable of being actuated from an extended bed frame position, where said telescopic unit has a maximum length and said backrest frame section, said connecting frame section and said foot frame section are arranged in a horizontal plane, to a sofa forming position, where said telescopic unit has a minimum length, said backrest frame section and said connection frame section are arranged side-by-side and extend generally uprightly relative to said base frame section, and said foot frame section extends above said base frame section;

said base frame section including a parallel pair of front and rear base frame rods, and a parallel pair of slide bars which interconnect left and right ends of said front and rear base frame rods, said rear end of said backrest frame section being mounted pivotally on said rear base frame rod, said opposite end of said telescopic unit being coupled to said slide bars;

said base frame section further including a plurality of leg members provided on said left and right ends of said front and rear base frame rods;

said backrest frame section including an outer backrest frame having a parallel pair of support sections disposed above said slide bars, and a bridging section transverse to said support sections and interconnecting rear ends of said support sections, said rear ends of said support sections being mounted pivotally on said rear base frame rod, said support sections having front ends connected pivotally to said rear end of said connecting frame section;

said backrest frame section further including at least one inner backrest frame confined by said outer backrest frame, said inner backrest frame having a front end mounted pivotally to said front ends of said support sections; and prop means, provided on said inner and outer backrest frames, for supporting releasably said inner backrest frame at a desired inclination relative to said outer backrest frame.

2. The folding sofa-bed frame as claimed in claim 1, wherein said prop means comprises:

an elongated locking plate having a first end portion mounted pivotally on said inner backrest frame, and a second end portion with a lower edge that is formed with a series of engaging notches; and a locking projection formed on said outer backrest frame for engaging a selected one of said engaging notches to support releasably said inner backrest frame in the desired inclination relative to said outer backrest frame.

3. The folding sofa-bed frame as claimed in claim 1, wherein said connecting frame section includes:

a parallel pair of side bars aligned respectively with said support sections of said outer backrest frame, said side bars having front ends mounted pivotally on said foot frame section, and rear ends mounted pivotally on said front ends of said support sections; and a pivot rod which extends between said side bars and which interconnects pivotally said side bars and said support sections.

4. The folding sofa-bed frame as claimed in claim 3, wherein said foot frame section comprises:

a parallel pair of side shafts which are aligned respectively with said side bars of said connecting frame section, said side shafts having front ends and rear ends mounted pivotally on said front ends of said side bars; and a connecting shaft extending between and interconnecting said front ends of said side shafts.

5. The folding sofa-bed frame as claimed in claim 4, wherein said foot frame section further comprises a mounting shaft extending between and interconnecting said rear ends of said side shafts, and a limiting shaft extending between said connecting and mounting shafts and parallel to said side shafts, said limiting shaft having a downwardly extending limiting portion which abuts against said front base frame rod to prevent undesired movement of said foot frame section away from said base frame section when said sofa-bed frame is in the sofa forming position.

6. The folding sofa-bed frame as claimed in claim 4, wherein said connecting shaft has left and right ends provided with a respective post member, each of said post members having a caster provided thereon to facilitate movement of said foot frame section toward or away from said base frame section.

7. The folding sofa-bed frame as claimed in claim 4, wherein said telescopic unit comprises:

a pair of tubular stationary members, each of which has a front end portion mounted on said foot frame section and an open rear end portion; and a pair of elongated slide members, each of which has a front end portion that extends slidably into said rear end portion of a respective one of said stationary members, and a rear end portion coupled to a respective one of said slide bars.

8. The folding sofa-bed frame as claimed in claim 7, wherein said rear end portion of each of said slide members is slidable along the respective one of said slide bars.

9. The folding sofa-bed frame as claimed in claim 7, wherein each of said slide bars has an inner face formed with an elongated slide groove that extends longitudinally thereof, said telescopic unit further including a transverse axle that interconnects said rear end portions of said slide members, and a pair of rollers provided on opposite ends of said axle and received in said slide grooves of said slide bars, respectively.

10. The folding sofa-bed frame as claimed in claim 1, further comprising spring means which interconnects said backrest frame section and said connecting frame section to bias said connecting frame section in the sofa forming position relative to said backrest frame section.

* * * * *